US008312887B2

(12) United States Patent
Dunn et al.

(10) Patent No.: US 8,312,887 B2
(45) Date of Patent: Nov. 20, 2012

(54) DISHWASHER BASKET INFANT FEEDING ACCESSORY HOLDERS

(75) Inventors: Steven B. Dunn, Beverly Hills, CA (US); Mark A. Hatherill, Beverly Hills, CA (US); Kevin D. Johnson, Tarzana, CA (US)

(73) Assignee: Munchkin, Inc., North Hills, CA (US)

( * ) Notice: Subject to any disclaimer, the term of this patent is extended or adjusted under 35 U.S.C. 154(b) by 68 days.

(21) Appl. No.: 12/762,548

(22) Filed: Apr. 19, 2010

(65) Prior Publication Data

US 2010/0193453 A1 Aug. 5, 2010

Related U.S. Application Data

(63) Continuation of application No. 10/948,938, filed on Sep. 24, 2004.

(51) Int. Cl.
*B08B 3/02* (2006.01)

(52) U.S. Cl. ..... 134/135

(58) Field of Classification Search ..... 134/135; 211/41.8, 41.9; 220/485, 486, 487; D32/3, D32/6, 25, 55
See application file for complete search history.

(56) References Cited

U.S. PATENT DOCUMENTS

| | | | | | |
|---|---|---|---|---|---|
| 1,527,326 | A | * | 2/1925 | Owens | 220/488 |
| 2,586,005 | A | * | 2/1952 | Colonna | 220/487 |
| 2,741,392 | A | * | 4/1956 | Weiss | 220/488 |
| 3,934,728 | A | * | 1/1976 | Guth | 211/41.9 |
| 4,193,588 | A | | 3/1980 | Doneaux | |
| 4,316,477 | A | * | 2/1982 | Song | 134/96.1 |
| 4,495,150 | A | | 1/1985 | Cook et al. | |
| 4,498,594 | A | | 2/1985 | Elder | |
| 4,512,489 | A | | 4/1985 | Green et al. | |
| 4,577,760 | A | * | 3/1986 | Rainin et al. | 206/508 |
| 4,732,291 | A | | 3/1988 | McConnell | |
| 4,748,993 | A | | 6/1988 | Llewellyn | |
| 4,830,200 | A | | 5/1989 | Zambano et al. | |
| 4,836,392 | A | | 6/1989 | Constantino | |
| 4,850,495 | A | | 7/1989 | Wallace | |
| 5,209,784 | A | * | 5/1993 | Bellman | 134/25.4 |
| 5,287,984 | A | | 2/1994 | Michael | |
| 5,344,029 | A | * | 9/1994 | Oghia et al. | 211/41.8 |
| 5,431,294 | A | * | 7/1995 | Stottmann et al. | 220/23.4 |
| 5,480,035 | A | | 1/1996 | Smith | |
| 5,649,630 | A | * | 7/1997 | Remmler | 211/41.8 |

(Continued)

FOREIGN PATENT DOCUMENTS

DE 36 41 020 * 8/1922

(Continued)

OTHER PUBLICATIONS

European Patent Office 1 275 336 Jan. 2003.*

(Continued)

*Primary Examiner* — Frankie L Stinson
(74) *Attorney, Agent, or Firm* — Robert Z. Evora, Esq.

(57) ABSTRACT

A dishwasher basket for use with baby bottle nipples includes a specially designed rack that maintains baby bottle nipples in an upright position during the washing and drying. The base of the nipple is also prevented from resting upon the surface of the rack. Feeding straw and valve holders are also provided that can be attached to the dishwasher basket. The dishwasher basket is able to be opened using only one hand.

19 Claims, 12 Drawing Sheets

U.S. PATENT DOCUMENTS

| | | | | |
|---|---|---|---|---|
| 5,840,261 | A * | 11/1998 | Monch | 422/300 |
| 6,089,411 | A | 7/2000 | Baudin et al. | |
| 6,325,220 | B1 * | 12/2001 | Malmstrom | 211/41.8 |
| 6,371,642 | B1 | 4/2002 | Nelson et al. | |
| 6,571,965 | B1 * | 6/2003 | Beck et al. | 211/41.8 |
| D488,891 | S | 4/2004 | Smith et al. | |
| 7,383,846 | B2 * | 6/2008 | Curran | 134/135 |
| 2002/0179604 | A1 | 12/2002 | Germain et al. | |
| 2003/0205258 | A1 | 11/2003 | McConnell et al. | |
| 2003/0205259 | A1 | 11/2003 | McConnell et al. | |
| 2004/0040586 | A1 | 3/2004 | Kumar | |
| 2004/0123885 | A1 | 7/2004 | Myong | |
| 2004/0169002 | A1 | 9/2004 | White-Wooten | |

FOREIGN PATENT DOCUMENTS

| | | | |
|---|---|---|---|
| DE | 29818725 | * | 12/1998 |
| EP | 0272795 | | 7/1992 |
| FR | 2 643 809 | * | 9/1990 |
| JP | 09-217920 | * | 8/1994 |
| WO | 02/087407 | | 11/2002 |

OTHER PUBLICATIONS

WIPO WO 2006/063899 Jul. 2006.*

* cited by examiner

DISHWASHER BASKET INFANT FEEDING ACCESSORY HOLDERS

This is a continuation of application Ser. No. 10/948,938, filed Sep. 24, 2004, the entire disclosure of which is hereby incorporated by reference as if set forth fully herein.

BACKGROUND OF THE INVENTION

1. Field of the Invention

This invention relates to the field of dishwasher racks, baskets and accessories. In particular the invention relates to nipple holders, straw holders, and non-spill cup valve holders for use with dishwashers.

2. Description of the Related Technology

A wide variety of accessories are used in the feeding of infants and children. Three of the products currently used to feed children and infants are baby bottles, straw cups, and non-spill cups. These products typically have parts that are small and difficult to wash properly in current dishwashing machines. Baby bottles have nipples, and cups can have straws and/or valves. Nipples, straws and valves tend to be small and awkwardly shaped. This makes it difficult to effectively clean nipples, straws and valves in current dishwashers.

In order to clean nipples, straws and valves effectively it is necessary that the interiors be struck with the water from the cleaning jets of the dishwasher. Current dishwashers typically have products placed randomly in a basket or in some other dishwasher accessory. Some dishwasher baskets provide methods for retaining a baby bottle nipple within the dishwasher basket. Some examples of dishwasher baskets for nipples are provided below.

U.S. Pat. No. 4,498,594 to Elder discloses having a dishwasher basket for nipples and baby bottles. The disclosed dishwasher basket has storage compartments for different sized nipples. Nipples are held by nipple positioners which extend upwards from the base of the basket into the interior of the nipple. The usage of the nipple positioners prevents the water jets from the dishwashers from adequately cleaning the interior of the nipples.

U.S. Pat. No. 4,512,489 to Green et al. discloses a dishwasher basket for holding nipples. Protuberances 24 are spaced equally and engage the top portion of a nipple. The basket is then positioned within the dishwasher so that the base of the nipple is resting on the surface of the dishwasher basket lid. Having the base of a nipple resting on the surface of the lid prevents the base of the nipple from being properly dried. This can encourage the growth of mildew and bacteria.

U.S. Pat. No. 4,748,993 to Llewellyn discloses having a rack for holding nipples in a dishwasher. The rack can accommodate different sized nipples, however this is accomplished by having smaller nipples simply be forced upwards during washing. See Col. 3, lines 57-68. Although the nipples are positioned upright, the bases of the nipples rest upon the rack, therefore preventing the bases of the nipples from drying properly. This can encourage the growth of mildew and bacteria.

U.S. Pat. No. 4,830,200 to Zambano et al. discloses a dishwasher basket for baby bottle parts. The teats of nipples 60 are placed between parallel wire assemblies 50 shown when wire assemblies 48 are swung down. Aligning the nipples in this dishwasher basket appears to be difficult since the nipples are first placed in the top container portion of the basket and then the lid that restrains the nipples during the dishwashing process must align with the nipples during the closing of the lid. Furthermore the base of the nipples are still resting upon a rack portion and therefore preventing the base of the nipple from adequately drying.

U.S. Pat. No. 4,836,392 to Constantino discloses a dishwasher basket for nipples. Nipples are placed upright on prongs 7. The placement of the nipples on prongs prevents the interior of the nipple from being properly cleaned.

U.S. Published Patent Application No. 2003/0205258 A1 to McConnell et al. discloses having a dishwasher basket for use with baby products. The nipples are not oriented so as to point upwards, but instead rest at an angle on rims 23. The position of the nipples prevents the interior from being properly cleaned, additionally the base of the nipples rest on central ridge 22, thereby preventing the base of the nipples from drying properly.

Although there are some dishwasher baskets out there that contemplate the problem of washing baby bottle nipples, none effectively provide a way to produce a thoroughly cleaned nipple. Furthermore, no dishwasher basket truly permits straws for children's cups or non-spill cup valves to be effectively cleaned. Simply placing the straw or valve in a silverware holder does not permit the entire interior of the straw or valve to be cleaned. Also, a silverware basket is usually placed in the lower rack of a dishwasher, while it may be at times desirable to use the upper rack of a dishwasher, where there is typically less heat.

A need therefore exists for providing a dishwasher basket that has effective means for enabling baby bottle nipples, cup straws and non-spill cup valves to be effectively and thoroughly cleaned while in a dishwasher.

Additionally, current dishwasher baskets require two hands to open, one hand on the main compartment of the basket and the other hand on the lid of the basket. A parent who has their hands full may not find it convenient to put everything down in order to open up the dishwasher basket to grab a straw or a baby bottle nipple. Therefore a need exists to enable a dishwasher basket to be opened using just one hand, permitting free use of the other hand.

SUMMARY OF THE INVENTION

Accordingly, it is an object of certain embodiments of the invention to provide improved holders for baby bottle nipples, straws for cups, and valves for cups.

According to a first aspect of the invention, an apparatus for positioning a drinking straw in a dishwasher includes a fixture that is constructed and arranged to be placed within a dishwasher, said fixture including straw mounting structure for securely holding at least one drinking straw in a predetermined position relative to the fixture.

According to a second aspect of the invention, a method of cleaning a drinking straw includes steps of securely mounting a drinking straw in a drinking straw mounting fixture; and using a dishwasher to clean the drinking straw while the drinking straw remains mounted in the drinking straw mounting fixture.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
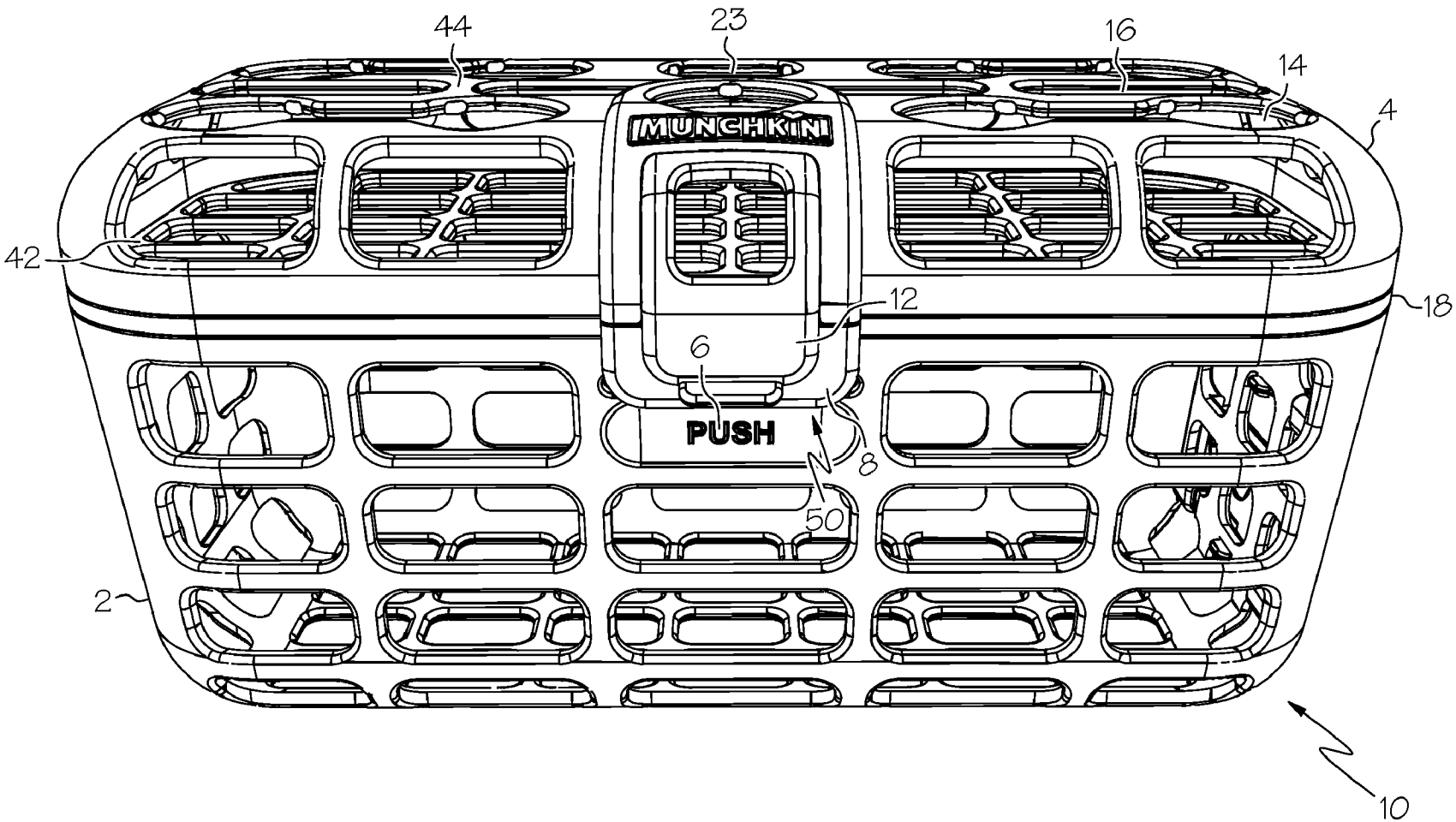
FIG. 1 is a front view of a dishwasher basket.

Referring now to the drawings, wherein like reference numerals designate corresponding structure throughout the views, and referring now to FIG. 1, a fixture or dishwasher basket 10 that is constructed according to a preferred embodiment of the invention is shown.

FIG. 1 shows a front view of dishwasher basket 10 in a closed position. Dishwasher basket 10 is designed to be placed within a dishwasher so that smaller articles may be placed within and throughout the dishwasher basket in order to prevent the smaller articles from becoming lost within the dishwasher. In alternative embodiments of the invention, the features of dishwasher basket 10 could be constructed as integral features of a dishwasher and not utilized as a supplemental product. Additionally, some features of dishwasher basket 10 may be utilized separately from dishwasher basket 10 and be constructed as separate articles or add-ons for existing dishwashers or dishwasher baskets. For example, nipple holders 14, 16, and 23, shown in FIGS. 1-4 and 7, may be placed on a separate rack and attached to a dishwasher, or alternatively may be an integral feature of a dishwasher rack. Straw holders 20, shown in FIGS. 2, 3, and 5, may additionally be separately attached to a dishwasher rack or constructed as an integral feature of a dishwashing machine or dishwasher basket.

Figure 2:
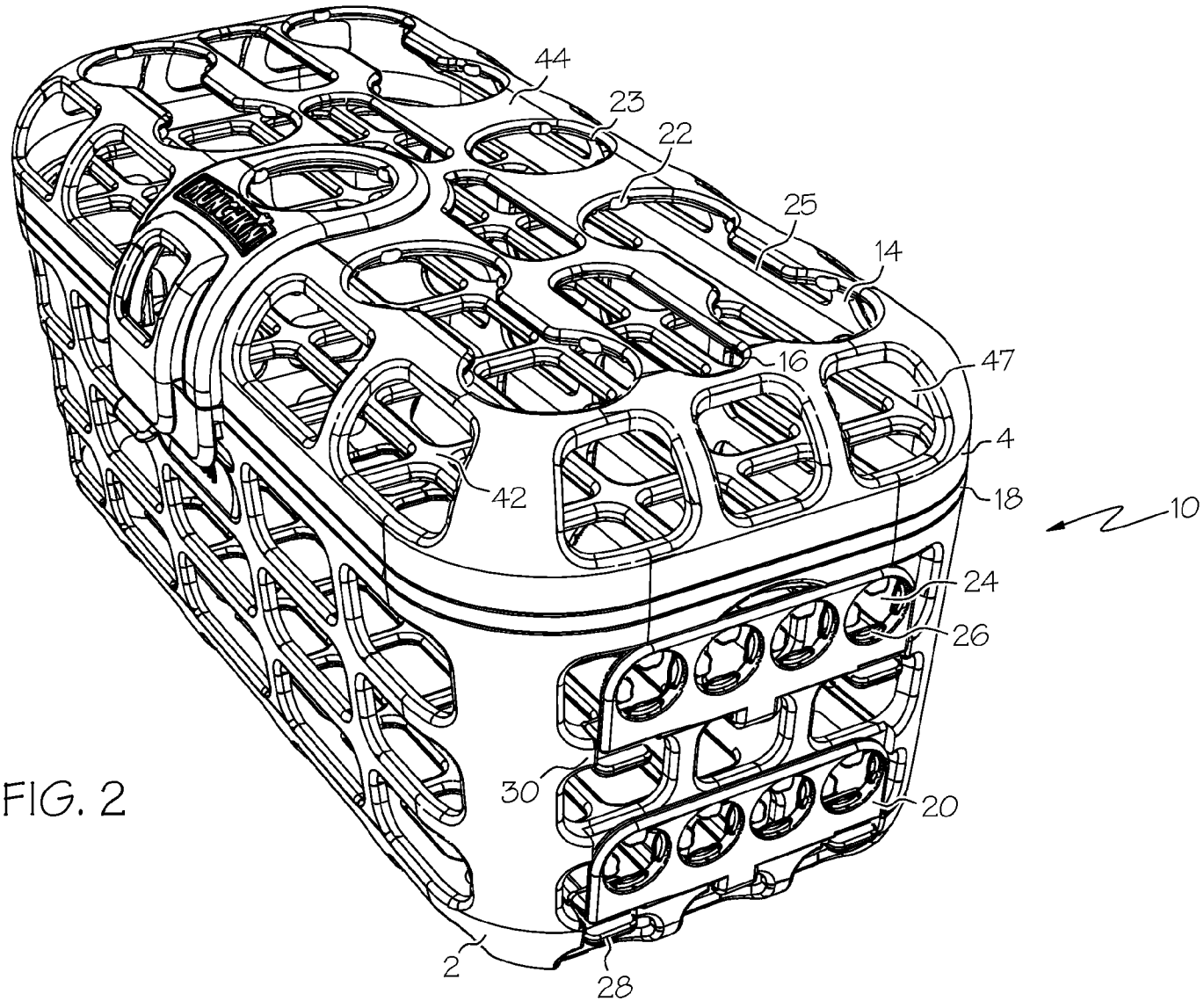
FIG. 2 is a top down isometric view of the dishwasher basket showing straw holders in a closed position.
Figure 3:
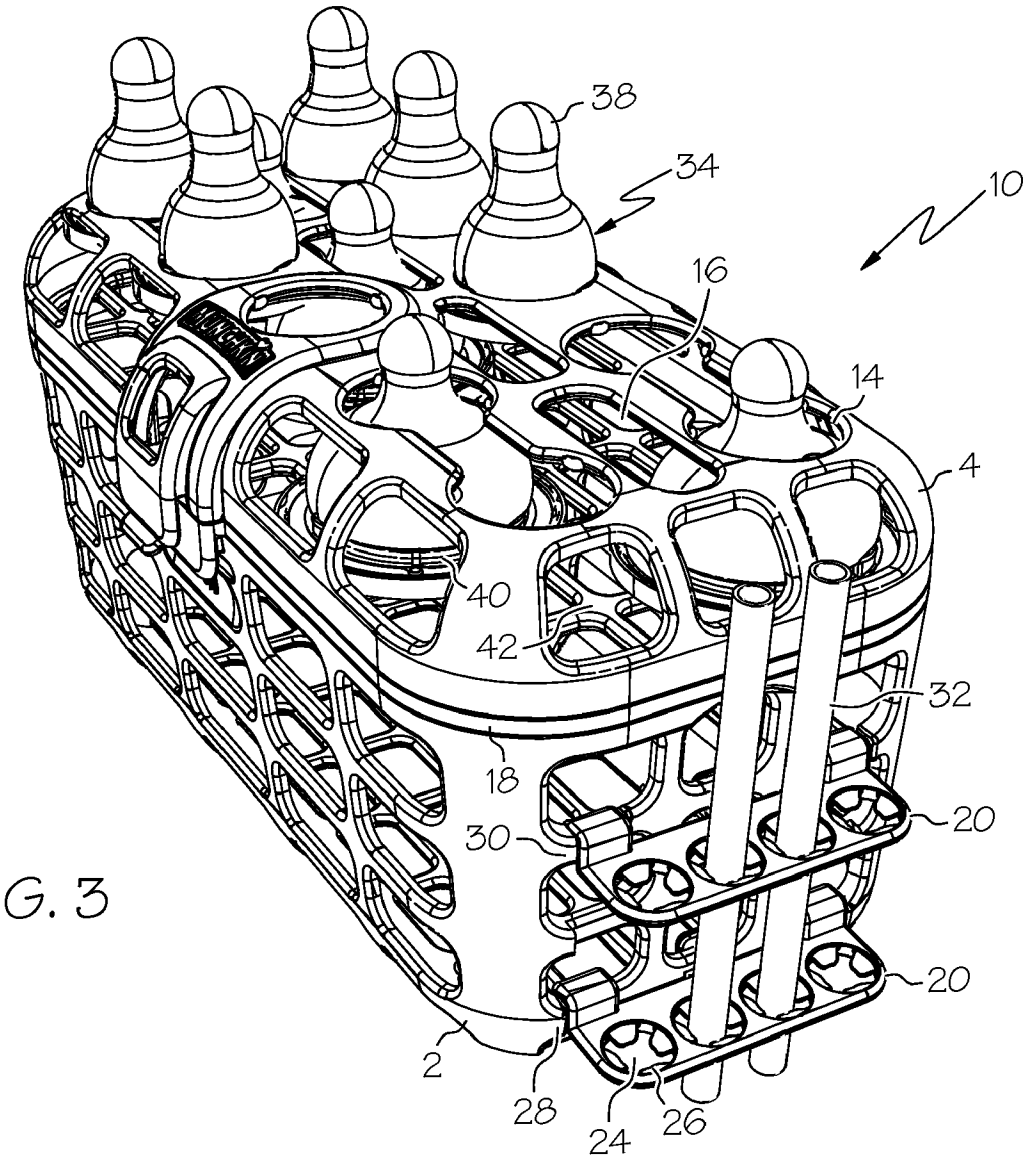
FIG. 3 is a top down isometric view of a dishwasher basket holding nipples and showing straw holders in a second opened position holding straws.

In the example shown in FIGS. 1-3, a dishwasher basket 10 having a lid 4, a container 2, and an interior rack 18 is shown. Lid 4, container 2, and interior rack 18 are preferably constructed out of polypropylene in order to be lightweight and relatively inexpensive to fabricate. However, they may be constructed out of more durable materials, such as nylon or stainless steel.

Interior rack 18 is connected to container 2 via hinge members (not shown). Proximate to the location where the hinge members used to attach interior rack 18 are connected, hinge members used in conjunction with lid 4 are attached. When in a closed position, lid 4 interlocks with interior rack 18 via lid locking member 12, which is part of locking system 50. Locking system 50 is described in more detail below. When lid 4 is interlocked with interior rack 18, both interior rack 18 and lid 4 can move as one unit about their respective hinge members, which pivot about a common axis. Interior rack 18 has interior rack locking member 8 that enables interior rack 18 and lid 4 to be secured to container 2. As is explained in greater detail below, upon being secured to container 2, a consumer can release interior rack 18 and lid 4 by pushing unlocking surface 6 located at the center of container 2.

Lid 4 comprises a nipple holding rack 44 that has a first nipple holder 14 and second nipple holder 16. A third nipple holder 23 may be additionally formed in lid 4, shown in FIG. 2. The nipple holders hold the nipples in an upright fashion within the dishwasher machine in order to permit the interior of the nipple to become thoroughly cleaned. In the shown embodiment, the nipple holders are formed as cutouts in lid 4. In alternative embodiments nipple holders may be formed in interior rack 18, or be formed in a separate rack placed elsewhere in dishwasher basket 10. Drainage spaces 42 are also provided in lid 4 to permit additional drainage from dishwasher basket 10 during dishwashing. In alternative embodiments, additional slots, holes, or cutouts, may be provided in the surface of lid 4 to permit additional drainage of dishwasher basket 10.

First nipple holder 14 is sized to hold nipples used with baby bottles by having nipple 34 placed in nipple holder 14 so that the top portion 38 of nipple 34 extends above lid 4, and bottom portion 40 of nipple 34 is below the surface of lid 4 and above the top surface of interior rack 18 shown in FIG. 3. A nipple is pulled up through first nipple holder 14 with the under cut 39, shown in FIG. 13, contacting the sides of first nipple holder 14. This secures nipple 34. Alternatively, as shown in FIG. 3, a wide mouth, or oversized nipple may be held stable in nipple holder 14 by its top portion 38. Nipple holder 14 may have a minimum diameter of between about 0.5 inches to about 2.0 inches, preferably a minimum diameter of between about 0.7 inches to about 1.75 inches.

Figure 4:
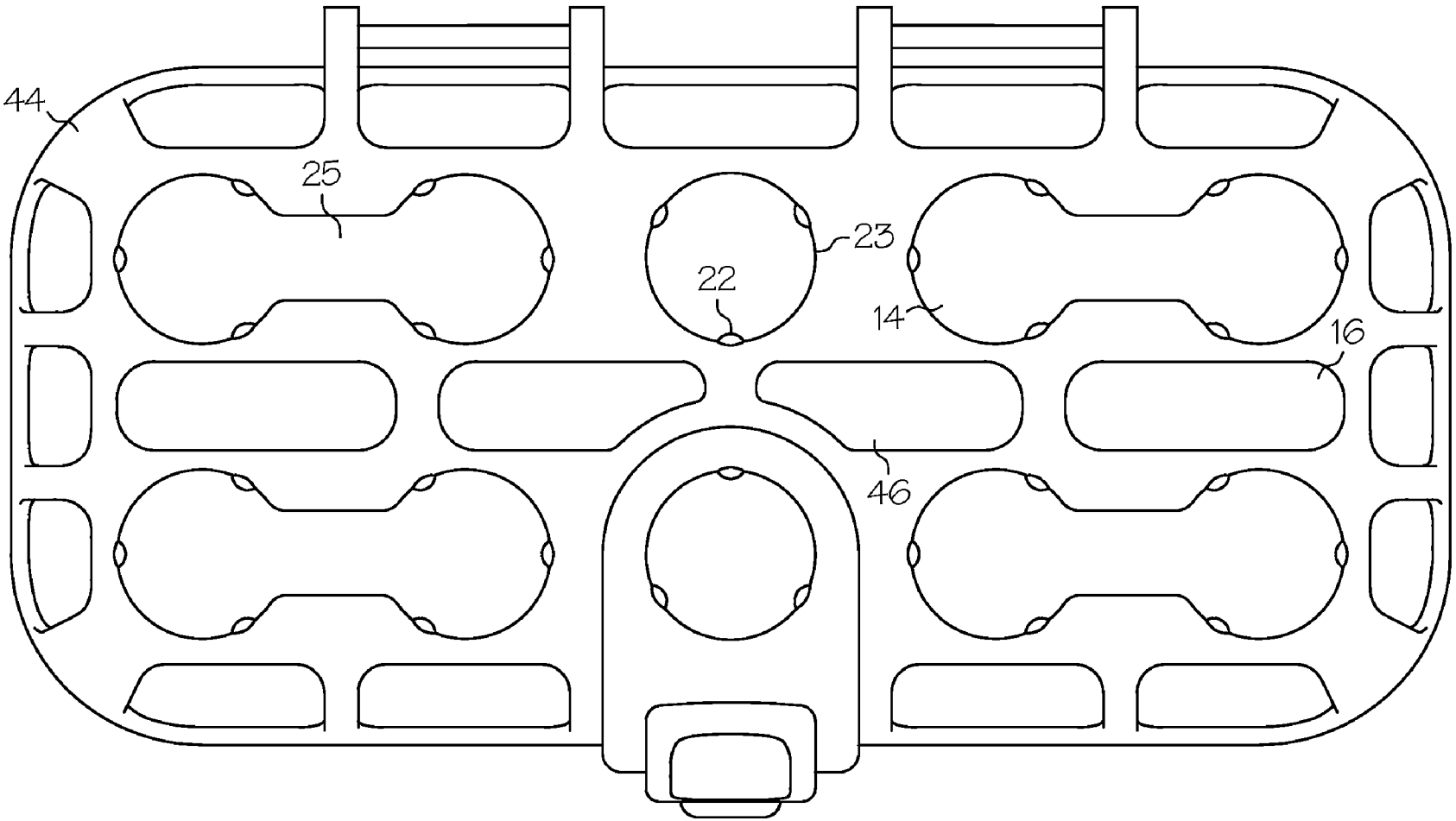
FIG. 4 is a top down view of a nipple holding rack.

Nipple holder protrusions 22, shown in FIG. 2 and FIG. 4, are arranged around the circumference of first nipple holder 14. Nipple holder protrusions 22 assist in securing different sizes and shapes of nipples. Undercut 39 of smaller sized nipples will be abutted by nipple holder protrusions 22, thereby permitting them to be maintained in an upright position without contacting interior rack 18. As shown in FIG. 4, nipple holder protrusions 22 preferably consist of three equidistantly spaced protrusions, however there may be as many protrusions as deemed necessary to effectively abut a nipple. In alternative embodiments, nipple holder protrusions 22 can be flexible so as to more easily accommodate varying sizes of nipples. Additionally, first nipple holder 14 is proximate to sizing space 25. Sizing space 25 permits the extra material from oversized nipples to fit into first nipple holder 14 while having the nipple maintain an upright position without contacting interior rack 18 and is constructed out of polypropylene. Sizing space 25 also functions as additional space for drainage of dishwasher basket 10 during and after dishwashing.

As shown in FIG. 3, second nipple holder 16 is sized to hold a baby bottle nipple 34 by a nipple's top portion 38. Second nipple holder 16 is used in the event that neither a first nipple holder 14 nor a third nipple holder 23 is available due to the number of nipples to be washed. Second nipple holder 16 can also maintain smaller sized nipples in an upright position and still prevent the smaller sized nipples from resting on interior rack 18. Additionally, a wide mouth, or oversized nipple may be held stable in nipple holder 16.

Third nipple holder 23, shown in FIG. 1 and FIG. 2, functions in the same manner as nipple holder 14 but does not use sizing spacer 25 to compensate for oversized nipples. In alternative embodiments the rack portion that forms lid 4 can be constructed entirely of third nipple holder 23 cutouts. It is also possible to secure a wide mouth, or oversized nipple by its top portion 38 with third nipple holder 23.

Figure 5:
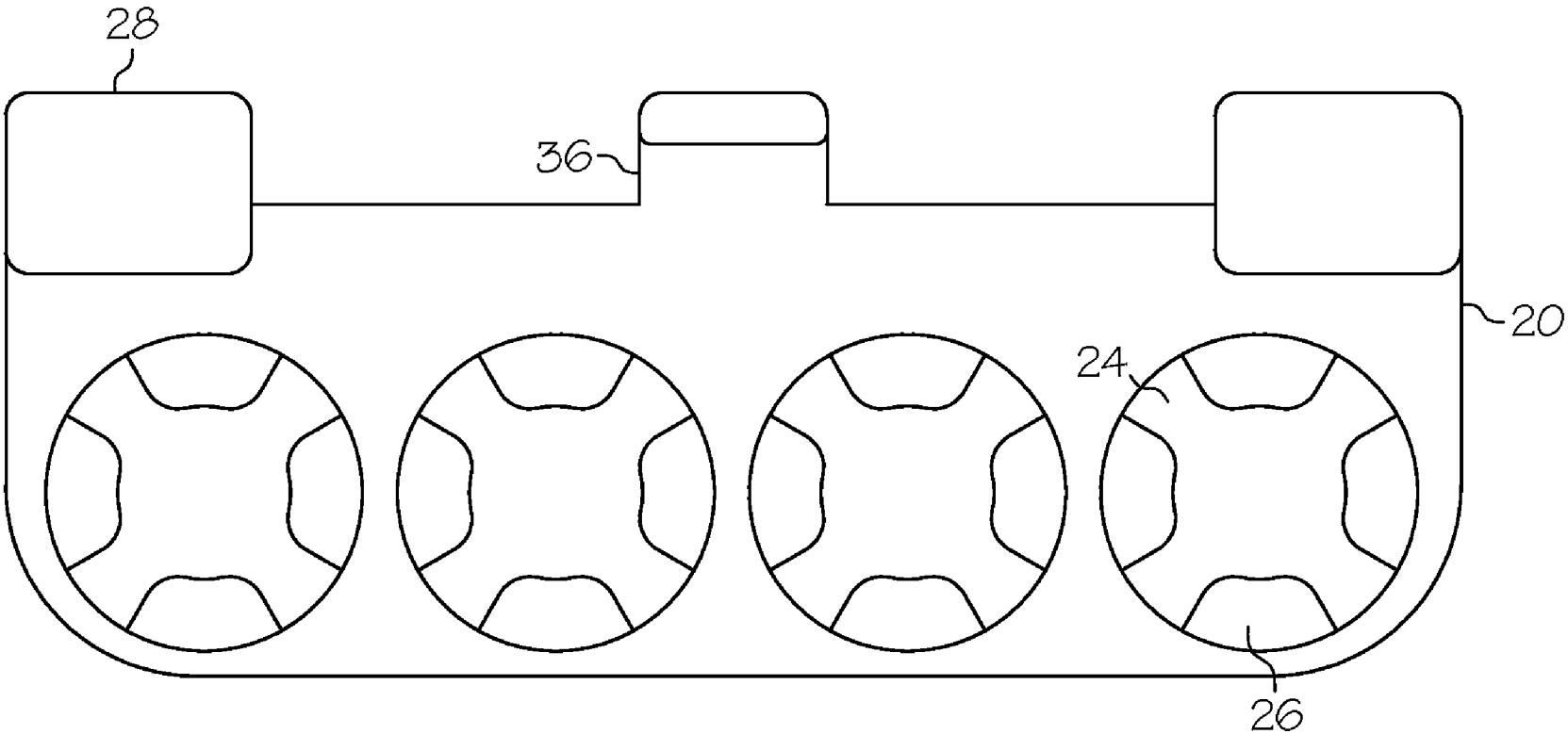
FIG. 5 is a top down view of the straw holder.

FIG. 2 shows a top down isometric view of dishwasher basket 10 showing straw holders 20 in a closed position. Straw holder 20 is preferably made of polyethylene. Straw holder 20 has two first hinge members 28 located at the distal ends of straw holder 20. First hinge members 28 are attached to container 2 at hinge attachment locations 30. Stop member 36, shown in FIG. 5, is also attached at hinge attachment location 30 and functions so as to limit the movement of straw holder 20 during the opening and closing of straw holder 20. The ability to move straw holder 20 from an open position to a closed position allows the dishwasher basket to be smaller in size for easier fitting into a dishwasher when straws are not being washed. In the event that straw holders 20 are not being used, they may be disconnected from the dishwasher basket 10. In the shown embodiment, first hinge members 28 are attached to the sides of container 2. Additional straw holders 20 may be attached to container 2 as needed.

In alternative embodiments straw holders 20 may be attached elsewhere in a dishwasher to a preexisting dishwasher basket or directly to a dishwasher rack. Additionally, other means for connection may be used such as permanent fixtures, for example ultrasonic welding, solvent bonding, or other non-permanent connectors, such as clips. Alternatively, straw holders 20 may be integrated into the basket.

Straw holders 20 are movable from a first position, shown in FIG. 2, to a second position, shown in FIG. 3. First hinge members 28 and stop member 36 cooperate in order to limit the movement of straw holders 20 so that movement of straw holders 20 between the first position and the second position is limited to a ninety-degree arc of travel. In FIG. 3, Straw holder 20 has a first surface and a second surface that together form a restricted passage. In FIG. 3 the first surface and second surface are the sides of the hole. These surfaces are used in order to mount the straw within straw holder 20. The two surfaces are preferably spaced apart a distance that is between about 0.2 to about 0.9 inches, and more preferably are spaced apart between about 0.25 and about 0.5 inches. In the illustrated embodiment shown in FIG. 3, two straw holders 20 are used in cooperation in order to hold straws 32. In alternative embodiments, fewer or more straw holders 20 may be used in order secure straws 32 depending on the available space located on dishwasher basket 10. Straw holders 20 secure straws 32 in an upright position during the usage of a dishwasher permitting the interior of straws 32 to be thoroughly cleaned.

As shown in FIGS. 2, 3, and 5, straw holder 20 has four straw holes 24. Straw hole 24 may be between about 0.2-0.9 inches, and is preferably are spaced apart between 0.25 and 0.5 inches. Each straw hole 24 has flexible tabs 26 extending from the inner circumference of straw hole 24. In the embodiment shown, four flexible tabs 26 are spaced equidistantly apart. In alternative embodiments there may be as many flexible tabs 26 as deemed necessary in order guide and retain straw 32. In the open, second position, flexible tabs 26 are angled radially inwardly and downwardly with respect to the location of lid 4. The angling of flexible tabs 26 assist in placing straws 32 into straw holes 24. In the embodiment shown, flexible tabs are flexible thereby permitting the flexible tabs 26 to bend slightly while placing a straw 32 into straw hole 24 and facilitating the placement of the straw within straw hole 24.

Figure 6:
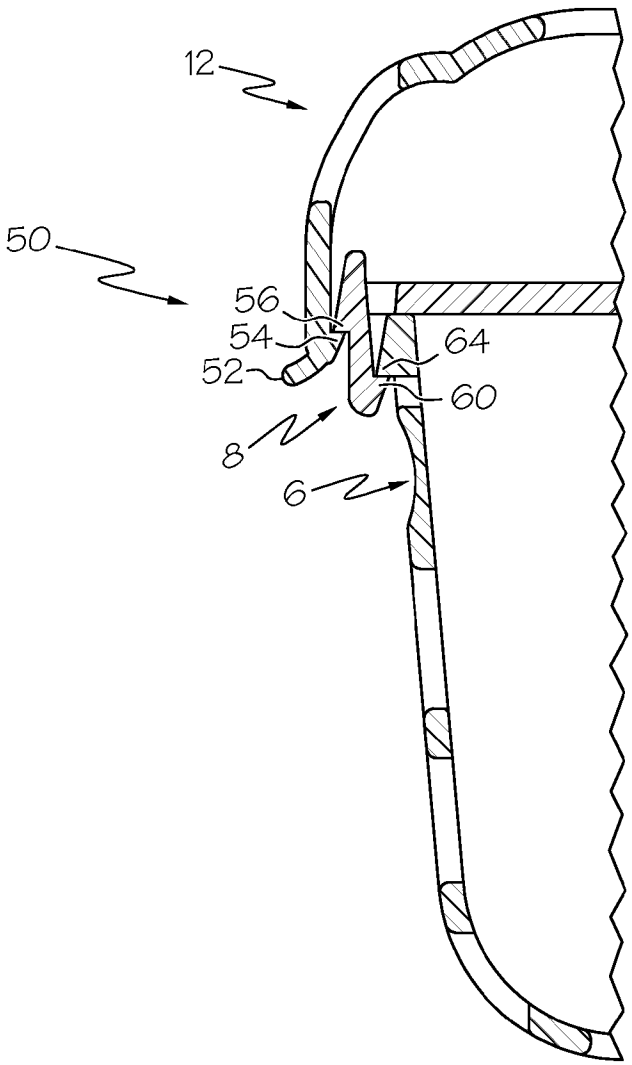
FIG. 6 is a cross-sectional view depicting a locking mechanism.

FIG. 6 shows locking system 50, shown in FIG. 1, in more detail. Locking system 50 comprises a lid locking member 12 located on lid 4 that interlocks with interior rack locking member 8 located on interior rack 18. Both lid locking member 12 and interior rack locking member 8 are then secured to container 2. Lid locking member 12 has a lid lock lip 52 that can be used by a consumer to disengage lid 4 from interior rack 18. First lid lock engagement portion 54 located on lid locking member 12 engages second lid locking engagement portion 56 located on interior rack locking member 8. When first lid lock engagement portion 54 engages second lid locking engagement portion 56, lid 4 is attached to interior rack 18 and both lid 4 and interior rack 18 can move as a single unit.

First lock member placement portion 58 and first lock member engagement portion 60 are located on interior rack lock member 8. First lock member placement portion 58 and first lock member engagement portion 60 are then used to engage second lock member placement portion (not shown) and second lock member engagement portion 64, respectively. Second lock member placement portion (not shown) and second lock member engagement portion 64 are located on container 2. Second lock member portion is a guide member that assists in guiding interior rack locking member 8. First lock member placement portion 58 cooperates with second lock member placement portion to help guide interior rack locking member 8. First lock member engagement portion 60 engages second lock member engagement portion 64 in order to secure interior rack locking member 8 to container 2. When unlocking surface 6 is depressed second lock member engagement portion 64 disengages first lock member engagement portion 60 and interior rack 18 and lid 4 are free to move away from container 2. Unlocking surface 6 can be depressed using just one hand. This enables a consumer to unlock the dishwasher basket while keeping one hand free.

Figure 7:
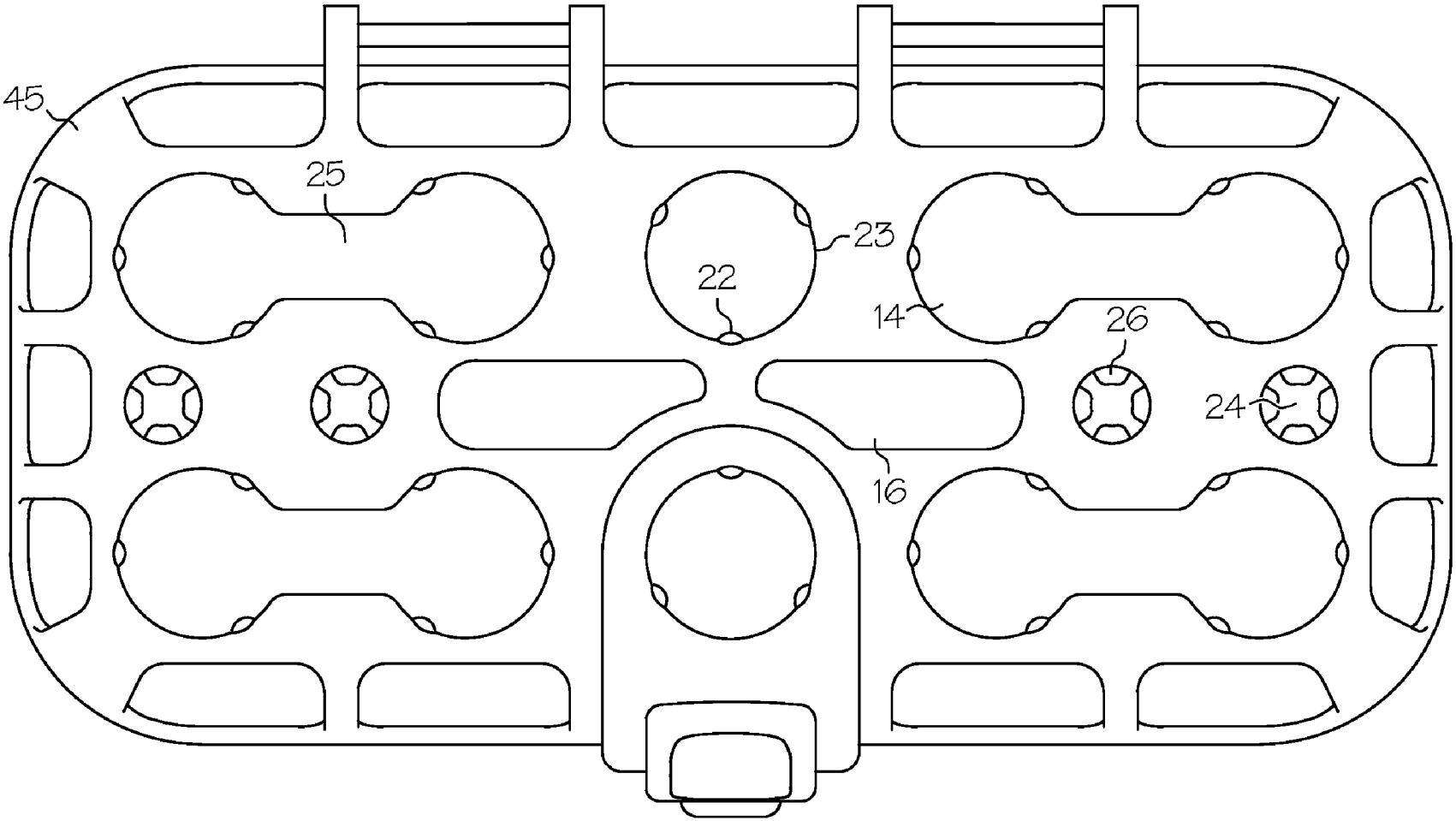
FIG. 7 is a top down view of an alternative embodiment of a straw holder.

FIG. 7 shows an alternative embodiment of a nipple holding rack. Nipple holding rack 45 has straw holes 24 and flexible tabs 26. Flexible tabs 26 are made of resilient elastomeric material and form part of the frictional engagement structure. Straw holes 24 and flexible tabs 26 permit straws to be held by nipple holding rack 45. This permits straws to be held in an upright position during dishwashing and permits thorough cleaning of the interior of straws. There can additionally be corresponding straw holes 24 and flexible tabs 26 aligned with straw holes 24 and flexible tabs 26 provided on nipple holding rack 45 that are provided on racks situated below nipple holding rack 45 in a dishwasher basket. When corresponding straw holes 24 and flexible tabs 26 are provided on racks situated below nipple holding rack 45 in a dishwasher basket, the straws are placed with straw holes 24 so as to be secured in two straw holes 24, similar to straws 32 held in FIG. 3. This would permit additional stabilizing of the straws during dishwashing and drying.

Figure 8:
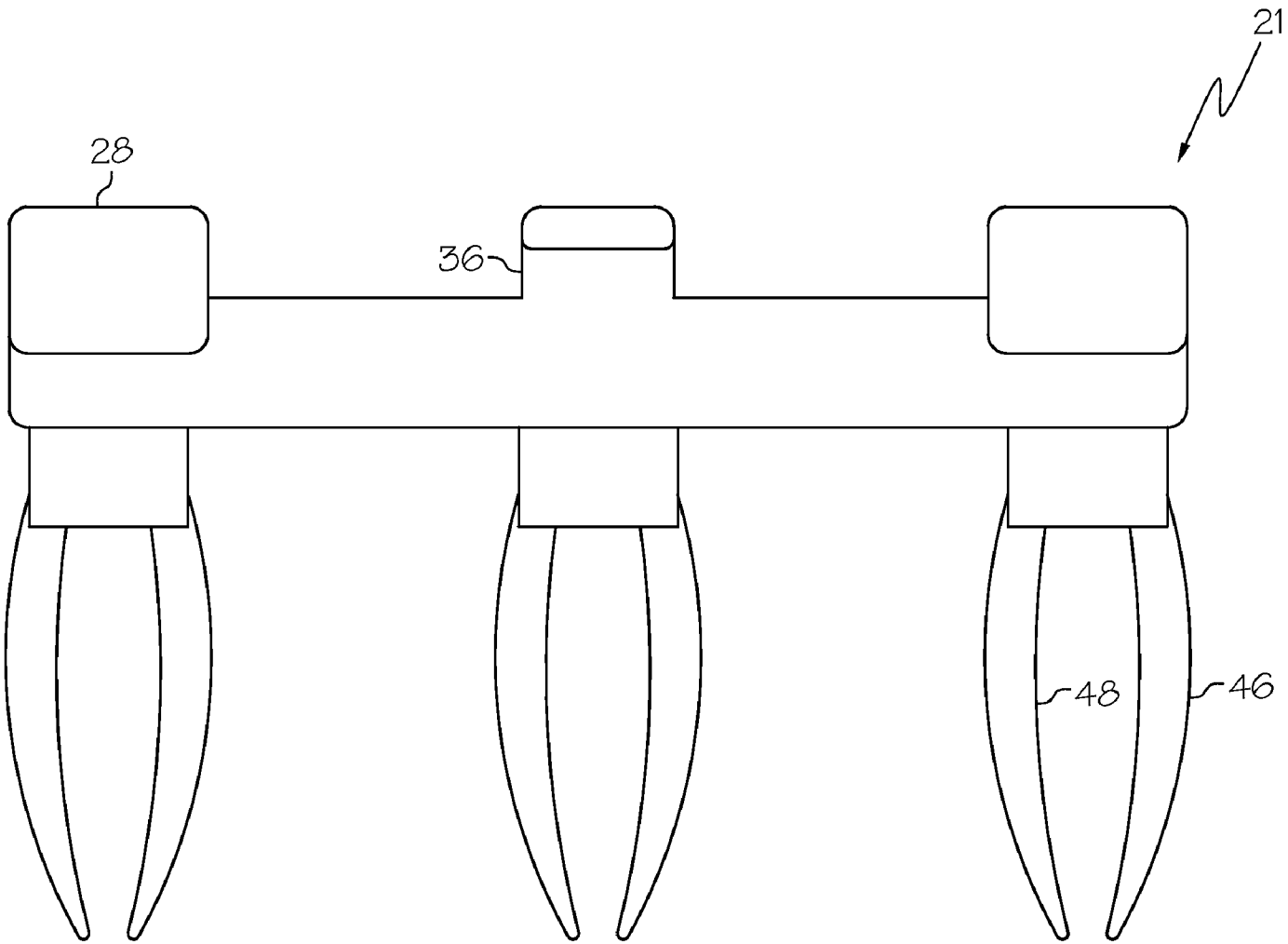
FIG. 8 is a detailed view of the locking system shown in FIG. 1.

FIG. 8 shows an alternative embodiment of straw holder. Straw holder 21 has first hinge members 28 and stop members 36. First hinge members 28 are attached to container 2 at hinge attachment locations 30. Stop member 36 is also attached at a hinge attachment location 30 and functions so as to limit the movement of straw holder 21 during the opening and closing of straw holder 21. In alternative embodiments, straw holder 21 may be attached directly within the dishwasher, or may be formed as an integral part of a dishwasher. First hinge members 28 and stop member 36 cooperate in order to limit the movement of straw holders 21 so that straw holders 21 when moved from a first position to a second position moves in a ninety-degree arc.

Straw holder 21 uses a resilient clip formed by first clip member 46 and second clip member 48 to secure straws. First clip member 46 and second clip member 48 are biased towards each other so that a constant force is applied to the surface of a straw when clipped. Straw holder 21 can be used in conjunction with additional straw holders 21 in order to provide more stability for a straw during the dishwashing process.

Figure 10:
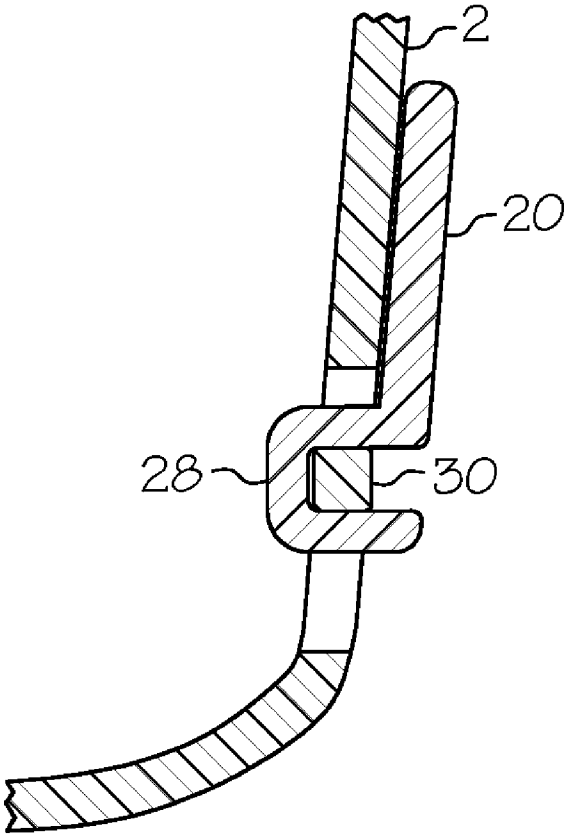
FIG. 10 is a side view of a first hinge of straw holder in the closed position.
Figure 9:
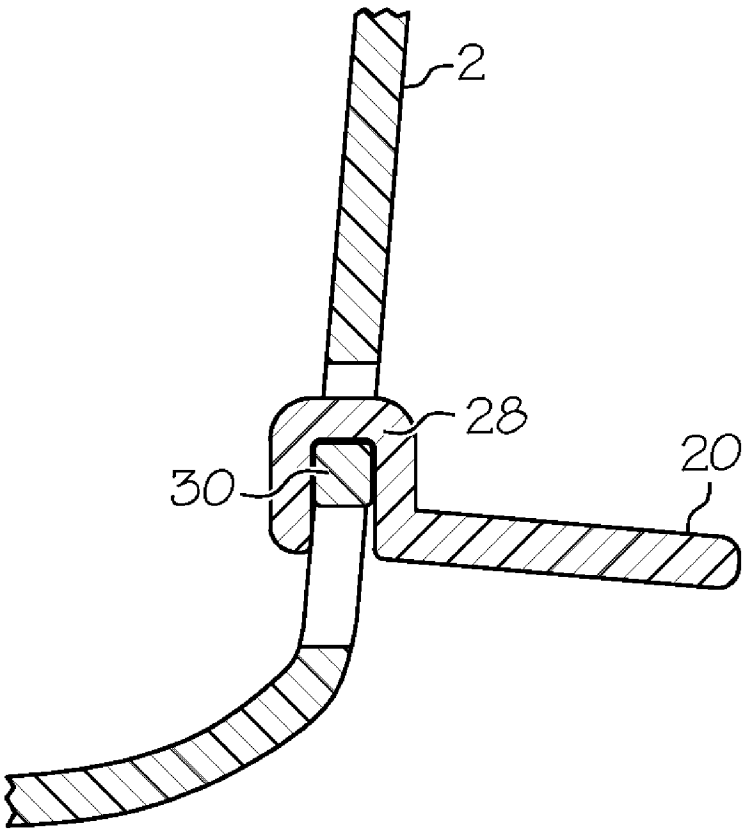
FIG. 9 is a side view of a first hinge of straw holder in an open position.

FIG. 9 shows a cross-sectional view of first hinge 28 of straw holder 20 in the open, second position. First hinge 28 is connected at attachment locations 30 on container 2. FIG. 10 shows a cross-sectional view of first hinge 28 of straw holder 20 in the closed, first position. As is shown in FIGS. 9 and 10, hinge 28 is constructed of an inner pin having an outer surface that has a square cross-section, and an outer housing having a square internal surface that rides over the outer surface as the hinge 28 moves between the first and second positions. Accordingly, straw holder 20 is biased so as to favor placement in either the first or second positions.

Figure 11:
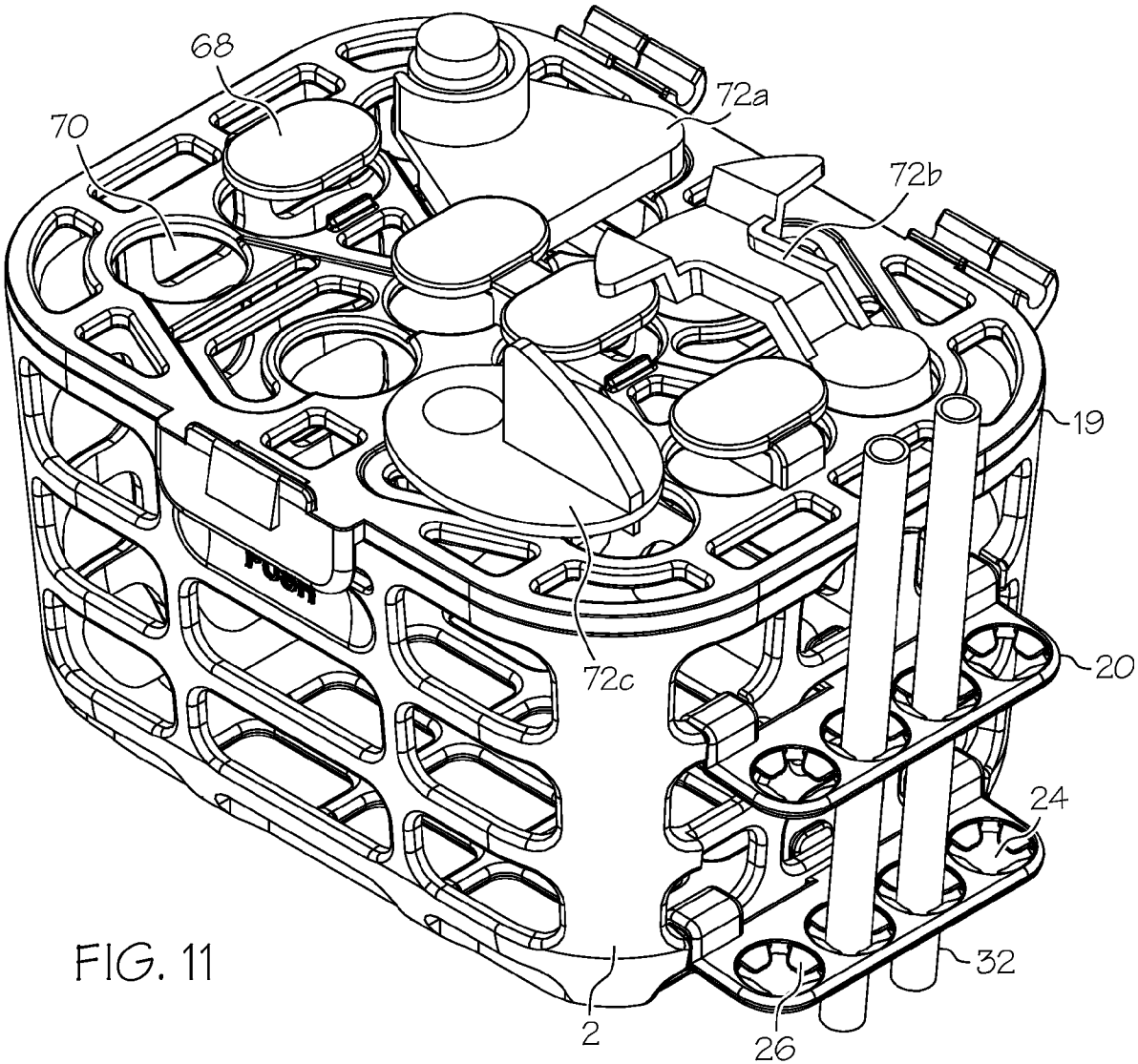
FIG. 11 is a top down isometric view of a dishwasher basket holding valves.
Figure 12:
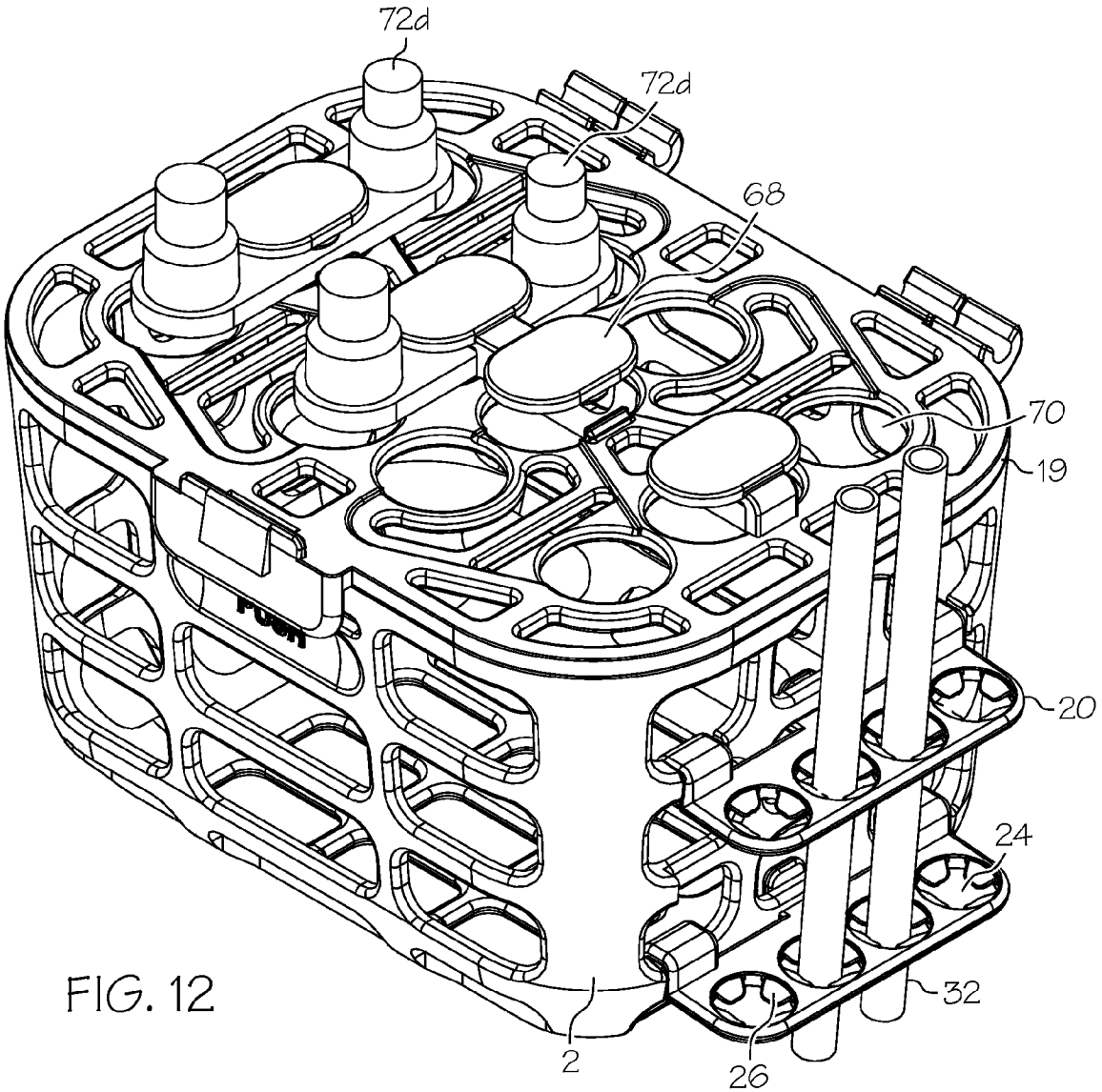
FIG. 12 is a top down isometric view of a dishwasher basket holding valves.

FIGS. 11 and 12 show an alternative embodiment of a dishwasher basket. In the alternative embodiment rack 19 is designed to hold non-spill cup valves. FIG. 11 shows rack 19 holding valves 72*a*, 72*b* and 72*c*. FIG. 12 shows valve 72*d* being held in rack 19. Rack 19 may be used in dishwasher basket 10, shown in FIGS. 1-3, in place of rack 18. Additionally, lid 4 shown in FIGS. 1-3 may be used with the dishwasher basket shown in FIGS. 11 and 12. Rack 19 may also be used separately.

Rack 19 is preferably constructed out of polypropylene in order to be lightweight and relatively inexpensive to fabricate. However, it may be constructed out of more durable materials, such as nylon or stainless steel.

Rack 19 has valve holding members 70 and valve retaining members 68. Rack 19 shown in FIGS. 11 and 12 has eight valve holding members 70 and four valve retaining members 68. The number of valve holding members 70 and valve retaining members 68 can vary depending on the size and shape of rack 19.

Valve holding member 70 generally consists of a hole in rack 19 that is preferably is sized to be within a range of about 0.1 inches to about 0.5 inches, and more preferably within a range of about 0.2 inches to about 0.4 inches. Valve holding member 70 may additionally have protrusions similar to those used with nipple holding member 14. Valve retaining member 68 is a raised portion generally oval in shape that is approximately 0.1 to 0.5 inches above the surface of rack 19, and is preferably between 0.2 and 0.4 inches above the surface of rack 19. A plastic support member suspends valve retaining member 68 above the surface of rack 19 and one plastic support member may support more than one valve retaining member 68.

Valve holding members 70 and valve retaining members 68 may work in conjunction in order to secure and mount various shaped non-spill cup valves. Valve holding members 70 and valve retaining members 68 maintain the valves in an upright position during the washing of the products. Being maintained in an upright position ensures that the valves are thoroughly cleaned.

FIGS. 11 and 12 show various types of valves that are used in non-spill cups. The valves illustrated are not exhaustive of the various possible configurations that a valve may take and that rack 19 may be able to hold. In FIG. 11 the base portion of a valve 72*a*, which is of a design that is sold by Munchkin, Inc., is retained in valve holding member 70 and portion of valve 72*a* is retained under the oval portion of valve retaining member 68. Valve retaining member 68 limits the movement of valve 72*a* by maintaining valve 72*a*'s position during the washing process. Valve 72*b* comes from a different type of non-spill cup, namely that marketed by Luv 'N Care, and a circular portion of valve 72*b* is placed in valve holding member 70, while another circular portion of valve 72*b* is placed in another valve holding member 70. Valve 72*c*, which is a design marketed by Gerber, is also held within valve holding member 70 and the top surface portion of valve 72*c* may additionally be retained by valve retaining member 68. Valve 72*d*, a type marketed by Playtex, shown in FIG. 12, is secured by valve retaining member 68. Alternatively, valve 72*d* may have the circular portions placed within valve holding members 70 and also be secured by valve retaining member 68.

Valve holding member 70 and valve retaining member 68 may be utilized separately from the dishwasher basket and be constructed as separate articles or add-ons for existing dishwashers or dishwasher baskets. For example, rack 19, may be attached to a dishwasher, or alternatively may be an integral feature of a dishwasher rack.

Figure 13:
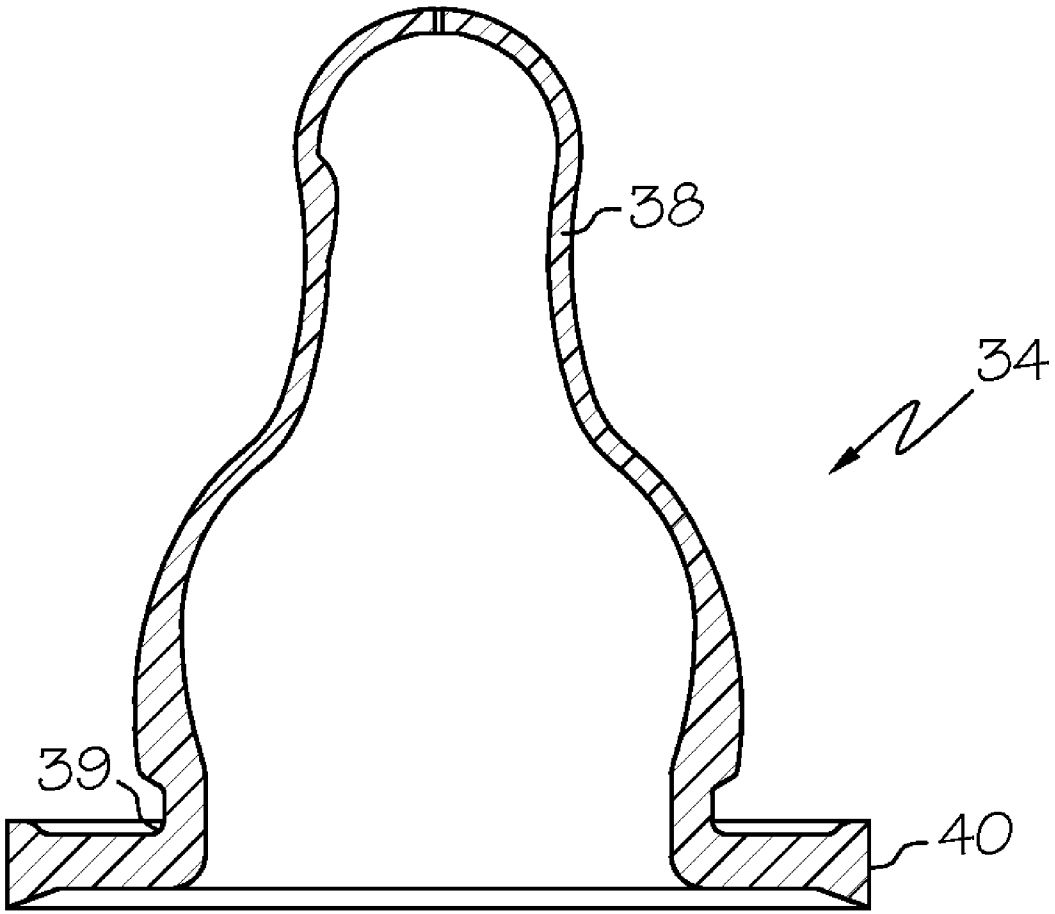
FIG. 13 is a cross-section of a nipple.

FIG. 13 shows a cross-sectional view of a nipple 34 for use with baby bottles. Nipple 34 has a top nursing portion 38 that is used for nursing infants. Nipple 34 further has a bottom mounting flange portion 40 that is wider in diameter than top portion 38. At the location where top portion 38 and bottom portion 40 meet is an undercut 39. In using dishwasher basket 10 shown in FIGS. 1-3, nipple 34 is placed in first nipple holder 14, or third nipple holder 23, so that top portion 38 of nipple 34 extends above lid 4, and bottom portion 40 of nipple 34 is below the surface of lid 4 and above the top surface of interior rack 18 shown in FIG. 3. Nipple 34 is pulled up through first nipple holder 14 with the undercut 39, shown in FIG. 13, contacting the sides of first nipple holder 14 and securing nipple 34. Additionally, nipple holder protrusions 22 may engage undercut 39 in order to further secure nipple 34 in first nipple holder 14, or third nipple holder 23.

While the structures disclosed above are described for the preferred use of mounting baby bottle nipples, feeding straws and valves within a dishwasher, it is equally within the invention to use the disclosed structure to mount such articles for other purposes, such as for a drying rack for drying the articles after hand washing and/or rinsing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dishwasher basket, comprising:

a container;

a lid that is hingedly mounted to the container; and an interior rack that is hingedly mounted to the container in a manner that is independent from the hinged mounting of the lid to the container, whereby each of the interior rack and the lid may be independently moved with respect to the container, wherein at least one of the lid and interior rack is constructed and arranged to hold an infant feeding accessory.

2. A dishwasher basket according to claim 1, further comprising a locking mechanism for selectively locking the lid to the interior rack.

3. A dishwasher basket according to claim 2, wherein the hinged mounting of the lid to the container and the hinged mounting of the interior rack to the container are constructed and arranged so that the lid and the interior rack can be moved together as a unit with respect to the container when the locking mechanism is engaged.

4. A dishwasher basket according to claim 2, wherein the locking mechanism further enables at least one of the lid and the interior rack to be locked to the container.

5. A dishwasher basket according to claim 4, wherein the locking mechanism further enables the interior rack to be locked to the container.

6. A dishwasher basket according to claim 1, wherein at least one of the lid and the interior rack is constructed and arranged to securely hold a baby bottle nipple within a dishwasher during dishwashing.

7. A dishwasher basket according to claim 6, wherein the interior rack includes a nipple mounting fixture for securely holding a baby bottle nipple within a dishwasher during dishwashing.

8. A dishwasher basket according to claim 7, wherein the interior rack further includes a straw mounting fixture for securely holding a drinking straw within a dishwasher during dishwashing.

9. A dishwasher basket according to claim 1, wherein at least one of the lid and the interior rack is constructed and arranged to securely hold a valve for a non-spill cup within a dishwasher during dishwashing.

10. A dishwasher basket according to claim 1, further comprising a fixture for securely holding a drinking straw within a dishwasher during dishwashing.

11. A dishwasher basket, comprising:

a container;

a lid that is hingedly mounted to the container; and an interior rack that is hingedly mounted to the container in a manner that is independent from the hinged mounting of the lid to the container, whereby the interior rack includes a nipple mounting fixture for securely holding a baby bottle nipple within a dishwasher during dishwashing and a straw mounting fixture for securely holding a drinking straw within a dishwasher during dishwashing.

12. A dishwasher basket according to claim 11, wherein each of the interior rack and the lid may be independently moved with respect to the container.

13. A dishwasher basket according to claim 11, wherein the lid is constructed and arranged to hold an infant feeding accessory.

14. A dishwasher basket according to claim 13, wherein the lid is constructed and arranged to securely hold a baby bottle nipple within a dishwasher during dishwashing.

15. A dishwasher basket according to claim 11, further comprising a locking mechanism for selectively locking the lid to the interior rack.

16. A dishwasher basket according to claim 15, wherein the locking mechanism further enables at least one of the lid and the interior rack to be locked to the container.

17. A dishwasher basket according to claim 16, wherein the locking mechanism further enables the interior rack to be locked to the container.

18. A dishwasher basket according to claim 11, wherein at least one of the lid and the interior rack is constructed and arranged to securely hold a valve for a non-spill cup within a dishwasher during dishwashing.

19. A dishwasher basket according to claim 11, further comprising a fixture for securely holding a drinking straw within a dishwasher during dishwashing.

* * * * *